United States Patent [19]

Hedges

[11] Patent Number: 4,595,147

[45] Date of Patent: Jun. 17, 1986

[54] SELF ATTRITION PULVERIZING MILL

[75] Inventor: Kenneth Hedges, San Pedro, Calif.

[73] Assignee: Garber & Hedges Incorporated, San Pedro, Calif.

[21] Appl. No.: 588,546

[22] Filed: Mar. 12, 1984

[30] Foreign Application Priority Data

Mar. 10, 1983 [AU] Australia ..... PF8376

[51] Int. Cl.[4] ..... B02C 13/09

[52] U.S. Cl. ..... 241/55; 241/101.2; 241/152 A; 241/275

[58] Field of Search ..... 241/275, 5, 40, 55, 241/56, 101.2, 186 R, 152 A, 152 R, 154, 26, 284

[56] References Cited

U.S. PATENT DOCUMENTS

| | | | |
|---|---|---|---|
| 2,573,129 | 10/1951 | Dulait | 241/275 X |
| 3,490,704 | 1/1970 | Bourne et al. | 241/186 R X |
| 3,640,275 | 2/1972 | Jung et al. | 241/275 X |
| 3,834,631 | 9/1974 | King | 241/275 X |

*Primary Examiner*—Mark Rosenbaum
*Attorney, Agent, or Firm*—Ladas & Parry

[57] ABSTRACT

A pulverizing mill having a rotor with a shaft at least resiliently supported to enable the rotor of the mill to rotate about its center of gravity.

4 Claims, 2 Drawing Figures

SELF ATTRITION PULVERIZING MILL

The present invention relates to pulverizing mills and more particularly relates to self attrition pulverizing mills.

There is disclosed herein a pulverizing mill comprising a hollow housing into which granular material to be milled is delivered, a rotor assembly rotatable within said housing and adapted to engage said material so as to reduce the granular size thereof, and wherein said rotor comprises a driven shaft, a plurality of angularly spaced slinger blades extending radially from said shaft, said blades being adapted to engage said material upon entering said housing to propel said material radially outwardly to impact against the internal surfaces of said housing so as to cause milling of said material, a plurality of blower blades spaced axially below said slinger blades being adapted to cause circulation of air within said housing to cause said material to flow therethrough, and wherein said rotor is at least partly supported by resilient bearing means which allow the rotor to rotate about its centre of gravity.

A preferred form of the present invention will now be described by way of example with reference to the accompanying drawings wherein.

Figure 1:
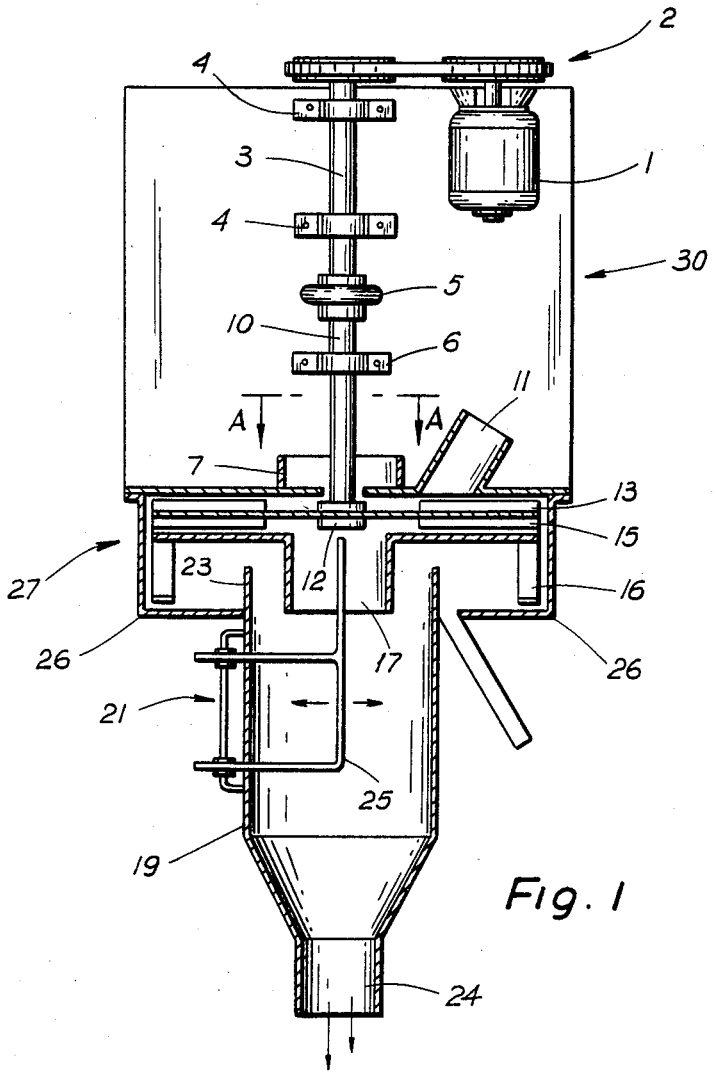
FIG. 1 is a schematic sectioned side elevation of an attrition mill.
Figure 2:
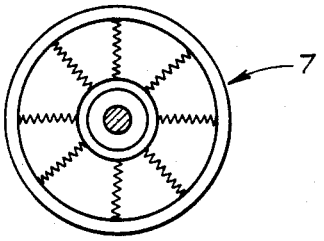
FIG. 2 is a schematic sectioned plan view of the mill of FIG. 1 sectioned along the line A—A.

In FIGS. 1 and 2 there is schematically illustrated a self attrition pulverizing mill 30. The mill 30 includes a motor 1 which drives a shaft 3 utilising a V belt sheath combination 2, or any other suitable drive 3, to transfer power to a shaft 10. The shaft 3 is supported by bearings 4 and drives the shaft 10 by means of a flexible coupling 5. The flexible coupling 5 accommodates any axial misalignment or displacement of the two shafts 3 and 10. The shaft 10 is supported by means of a self aligning bearing 6 and a spring loaded bearing 7 which is more fully depicted in FIG. 2. The shaft 10 is rigidly coupled through a welded hub and bushing 12 to rotor assembly 27. Because of this arrangement, the rotor, if unbalanced due to wear or any reason, will rotate about its true centre of gravity without harmful vibration.

Dry material, smaller than 1 inch diameter is continuously fed to inlet 11 where it is slung by slinger bars 13 to the periphery of the mill causing the material to crush due to impact. The finer material is then carried by the rotor bars 16 in a circumferential manner around the periphery of the mill where attrition between particles and the periphery of the mill, reduces the particle size.

Internal air flow is caused by blower blades 15 which force a rotating air stream axially to the cyclone 19 and back through cyclone riser 17 and then to the blower blades 15. This arrangement causes an air drag force on the particles which opposes the centrifugal force on the particles due to the rotor. High air velocities at constant rotor speed results in coarser product exiting through the outlet 24. High rotor speed at constant air velocities results in a finer product.

Thus, particularly size can be controlled by either rotor speed or by air velocity. Rotor speed can be controlled by any variable drive. Air velocities can be controlled by the stripper rod control 21 which can move the stripper rod 25 from the periphery of the rotating riser pipe 17 to the centre of the riser pipe 17. If the stripper rod is at the centre of the riser pipe 17 then centrifugal force fills the riser pipe 17 with fine particles that have escaped cyclone collection by the cyclone 19. The finest particles for a constant rotor speed are collected when air velocities approach zero.

If the stripper rod is controlled so as to be near the periphery of the riser pipe 17, then coarser material will result from a constant rotor speed.

The deflector ring 23 prevents coarse material from escaping the opposing forces of the mill action. This particular ring 23 substantially increases efficiency of the mill.

Coarser, high density materials tend to travel near the bottom plate of the mill enclosure 26 because of lower velocities near the bottom plate due to friction and therefore low centrifugal forces. The outlet 20 collects these high density, coarse particles.

It should be appreciated that the abovementioned rotor consists of items 13 to 18 inclusive.

What I claim is:

1. A pulverizing mill comprising a hollow housing into which granular material to be milled is delivered, a vertical drive shaft, a rotor assembly rotatable within said housing adapted to engage said material so as to reduce the granular size thereof, and wherein said rotor assembly comprises a driven shaft which is generally vertically extending and drivingly connected to said drive shaft by a flexible coupling to allow relative misalignment of the shafts, a plurality of angularly spaced slinger blades extending radially from said driven shaft, said blades being adapted to engage said material upon entering said housing to propel said material radially outwardly to impact against the internal surfaces of said housing so as to cause milling of said material, a plurality of blower blades spaced axially below said slinger blades and being adapted to cause circulation of air axially within said housing to cause said material to flow therethrough, a plurality of rotor bars located adjacent said internal surfaces and mounted on said shaft so as to rotate therewith, said bars being provided to engage particles of said granular material to cause further milling thereof, resilient bearing means supporting said rotor and allowing said rotor to rotate about its centre of gravity, said bearing means including an alignment bearing located towards the upper end of said driven shaft, and a flexible bearing spaced axially downward of said alignment bearing.

2. The mill of claim 1 wherein said rotor bars depend downwardly from said slinger blades adjacent the radially outer portions thereof.

3. The mill of claim 2 wherein said flexible bearing comprises a plurality of springs extending radially from said shaft to allow centering thereof for rotation about the centre of gravity of the rotor assembly.

4. The mill of claim 3 wherein said slinger blades and blower blades are located adjacent one end of said shaft remote from said flexible coupling.

* * * * *